US008475993B2

(12) United States Patent
Ikuta

(10) Patent No.: US 8,475,993 B2
(45) Date of Patent: Jul. 2, 2013

(54) TONER AND METHOD FOR PRODUCING THE SAME

(75) Inventor: Masahiro Ikuta, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 314 days.

(21) Appl. No.: 12/950,121

(22) Filed: Nov. 19, 2010

(65) Prior Publication Data

US 2011/0123923 A1 May 26, 2011

Related U.S. Application Data

(60) Provisional application No. 61/263,491, filed on Nov. 23, 2009.

(51) Int. Cl.
*G03G 5/00* (2006.01)

(52) U.S. Cl.
USPC ..... 430/137.14; 430/108.1; 430/108.21; 430/110.2

(58) Field of Classification Search
USPC ..... 430/137.14, 108.1, 108.21, 110.2
See application file for complete search history.

(56) References Cited

U.S. PATENT DOCUMENTS

2009/0087767 A1 4/2009 Nakamura
2010/0209839 A1 8/2010 Kabai et al.

*Primary Examiner* — Mark A Chapman
(74) *Attorney, Agent, or Firm* — Turocy & Watson, LLP

(57) ABSTRACT

A method for producing a decolorable toner comprising: forming particles containing a color former compound, a color developing agent, and a binder resin; forming first aggregated particles by aggregating and fusing the particles containing the color former compound, the color developing agent, and the binder resin in a dispersion medium; and forming second aggregated particles by aggregating and fusing the first aggregated particles and a binder resin in a dispersion medium.

8 Claims, 4 Drawing Sheets

FIG. 4

| | Volume D50 (μm) | | Volume D50 of first aggregated particles / Volume D50 of second aggregated particles | Volume D50 of toner particles (μm) | Cooling temperature for first aggregated particles | Evaluation | | |
|---|---|---|---|---|---|---|---|---|
| | First aggregated particles | Second aggregated particles | | | | Color developing property (ID) | Color erasing property | Image quality |
| Example 1 | 1.19 | 5.13 | 23.2% | 5.10 | 30 | A | A | A |
| Example 2 | 1.26 | 5.41 | 23.3% | 5.46 | 30 | A | A | A |
| Example 3 | 0.59 | 12.5 | 4.7% | 12.48 | 30 | C | B | D |
| Example 4 | 0.87 | 10.21 | 8.5% | 12.48 | 30 | B | B | C |
| Example 5 | 2.68 | 5.79 | 46.3% | 5.87 | 30 | A | A | C |
| Example 6 | 3.25 | 6.24 | 52.1% | 6.21 | 30 | A | A | D |
| Example 7 | 0.86 | 2.85 | 30.2% | 2.80 | 30 | B | B | C |
| Example 8 | 1.34 | 3.27 | 41.0% | 3.34 | 30 | A | A | B |
| Example 9 | 2.67 | 14.25 | 18.7% | 14.36 | 30 | A | A | B |
| Example 10 | 2.49 | 17.61 | 14.1% | 17.52 | 30 | A | A | C |
| Example 11 | 1.46 | 6.16 | 23.7% | 6.27 | 55 | A | A | B |
| Comparative Example 1 | – | 7.61 | – | 7.61 | – | D | B | C |

TONER AND METHOD FOR PRODUCING THE SAME

CROSS-REFERENCE TO RELATED APPLICATION

This application is also based upon and claims the benefit of priority from U.S. provisional application 61/263,491, filed on Nov. 23, 2009; the entire contents of which are incorporated herein by reference.

FIELD

Embodiments described herein relate to a technique for a decolorable toner which is used for developing an electrostatic image or a magnetic latent image by an electrophotographic process, an electrostatic printing process, or the like.

BACKGROUND

As a method for producing a toner, which contains a color former compound, a color developing agent, and optionally a color erasing agent and is capable of erasing an image formed on a recording medium by erasing the color, a melt-kneading method is usually adopted. The melt-kneading method is a method for producing desired toner particles by melt-kneading a binder resin, a color former compound, a color developing agent, a release agent such as a wax, a charge control agent, and the like, cooling the resulting kneaded material, finely pulverizing the cooled material, and then, classifying the resulting fine particles.

However, in the case of producing the toner particles by a melt-kneading method, kneading is performed at a high temperature of, for example, about 200° C., and therefore, the color former compound and the color developing agent are uniformly dispersed in the binder resin. Since the color is developed by reacting the color former compound with the color developing agent, if the color former compound and the color developing agent are uniformly dispersed, the color developing property is decreased.

Further, in the case of producing the toner particles by a melt-kneading method, when a binder resin or the like has a color erasing action, the color is erased during kneading, and therefore, it is necessary to select a material which does not have a color erasing action as a binder resin to be used in the production. Accordingly, a binder resin having excellent fixability sometimes could not be used in the production of a toner.

Further, although the reduction in the particle diameter of a toner is demanded for achieving a high-quality image, there is a limit to the reduction in the particle diameter by a melt-kneading method.

DESCRIPTION OF THE DRAWINGS

FIG. 4 is a table showing the properties of toners of Examples.

DETAILED DESCRIPTION

Figure 1:
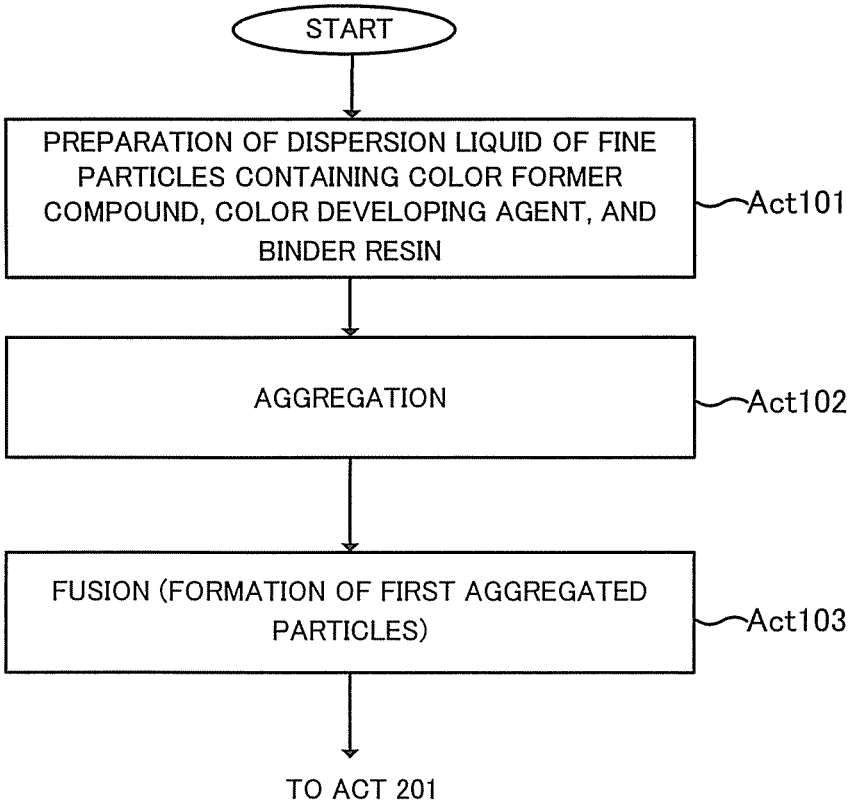
FIG. 1 is a process flow chart according to one example of a method for producing a toner of an embodiment.

A method for producing a decolorable toner according to this embodiment comprises: forming fine particles containing a color former compound, a color developing agent, and a binder resin; forming first aggregated particles by aggregating and fusing the fine particles containing the color former compound, the color developing agent, and the binder resin in a dispersion medium; and forming second aggregated particles by aggregating and fusing the first aggregated particles and a binder resin in a dispersion medium.

Hereinafter, embodiments will be described with reference to the drawings.

In this embodiment, a toner containing a coloring agent and a binder resin is produced. In this specification, the coloring agent refers to one kind of compound or a composition that imparts a color to the toner. In this embodiment, the coloring agent contains a color former compound and a color developing agent.

The color former compound is not particularly limited and can be appropriately determined by a person skilled in the art, however, for example, a leuco dye can be used. Examples of the leuco dye include diphenylmethane phthalides, phenylindolyl phthalides, indolyl phthalides, diphenylmethane azaphthalides, phenylindolyl azaphthalides, fluorans, styrynoquinolines, and diaza-rhodamine lactones.

Specific examples thereof include 3,3-bis(p-dimethylaminophenyl)-6-dimethylaminophthalide, 3-(4-diethylaminophenyl)-3-(1-ethyl-2-methylindol-3-yl)phthalide, 3,3-bis(1-n-butyl-2-methylindol-3-yl)phthalide, 3,3-bis(2-ethoxy-4-diethylaminophenyl)-4-azaphthalide, 3-(2-ethoxy-4-diethylaminophenyl)-3-(1-ethyl-2-methylindol-3-yl)-4-azaphthalide, 3-[2-ethoxy-4-(N-ethylanilino)phenyl]-3-(1-ethyl-2-methylindol-3-yl)-4-azaphthalide, 3,6-diphenylaminofluoran, 3,6-dimethoxyfluoran, 3,6-di-n-butoxyfluoran, 2-methyl-6-(N-ethyl-N-p-tolylamino)fluoran, 2-N,N-dibenzylamino-6-diethylaminofluoran, 3-chloro-6-cyclohexylaminofluoran, 2-methyl-6-cyclohexylaminofluoran, 2-(2-chloroanilino)-6-di-n-butylaminofluoran, 2-(3-trifluoromethylanilino)-6-diethylaminofluoran, 2-(N-methylanilino)-6-(N-ethyl-N-p-tolylamino)fluoran, 1,3-dimethyl-6-diethylaminofluoran, 2-chloro-3-methyl-6-diethylaminofluoran, 2-anilino-3-methyl-6-diethylaminofluoran, 2-anilino-3-methyl-6-di-n-butylaminofluoran, 2-xylidino-3-methyl-6-diethylaminofluoran, 1,2-benz-6-diethylaminofluoran, 1,2-benz-6-(N-ethyl-N-isobutylamino)fluoran, 1,2-benz-6-(N-ethyl-N-isoamylamino)fluoran, 2-(3-methoxy-4-dodecoxystyryl)quinoline, spiro[5H-(1)benzopyrano(2,3-d)pyrimidine-5,1'(3'H)isobenzofuran]-3'-one,2-(diethylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-methyl-, spiro[5H-(1)benzopyrano(2,3-d)pyrimidine-5,1'(3'H)isobenzofuran]-3'-one, 2-(di-n-butylamino)-8-(diethylamino)-4-methyl-, spiro[5H-(1)benzopyrano(2,3-d)pyrimidine-5,1'(3'H)isobenzofuran]-3'-one, 2-(di-n-butylamino)-8-(N-ethyl-N-i-amylamino)-4-methyl-, spiro[5H-(1)benzopyrano(2,3-d)pyrimidine-5,1'(3'H)isobenzofuran]-3'-one, 2-(di-n-butylamino)-8-(di-n-butylamino)-4-phenyl, 3-(2-methoxy-4-dimethylaminophenyl)-3-(1-butyl-2-methylindol-3-yl)-4,5,6,7-tetrachlorophthalide, 3-(2-ethoxy-4-diethylaminophenyl)-3-(1-ethyl-2-methylindol-3-yl)-4,5,6,7-tetrachlorophthalide, and 3-(2-ethoxy-4-diethylaminophenyl)-3-(1-pentyl-2-methylindol-3-yl)-4,5,6,7-tetrachlorophthalide. Additional examples thereof include pyridine compounds, quinazoline compounds, and bisquinazoline compounds. These compounds may be used by mixing two or more of them.

The color developing agent to be used in this embodiment is an electron accepting compound which donates a proton to the color former compound such as a leuco dye. Examples thereof include phenols, metal salts of phenols, metal salts of carboxylic acids, aromatic carboxylic acids, aliphatic carboxylic acids having 2 to 5 carbon atoms, benzophenones, sulfonic acids, sulfonates, phosphoric acids, metal salts of phosphoric acids, acidic phosphoric acid esters, metal salts of acidic phosphoric acid esters, phosphorous acids, metal salts of phosphorous acids, monophenols, polyphenols, 1,2,3-triazole, and derivatives thereof. Additional examples thereof include those having, as a substituent, an alkyl group, an aryl group, an acyl group, an alkoxycarbonyl group, a carboxy group or an ester thereof, an amide group, a halogen group, or the like, and bisphenols, trisphenols, phenol-aldehyde condensed resins, and metal salts thereof. These compounds may be used by mixing two or more of them.

Specific examples thereof include phenol, o-cresol, tertiary butyl catechol, nonylphenol, n-octylphenol, n-dodecylphenol, n-stearylphenol, p-chlorophenol, p-bromophenol, o-phenylphenol, n-butyl p-hydroxybenzoate, n-octyl p-hydroxybenzoate, benzyl p-hydroxybenzoate, dihydroxybenzoic acid or esters thereof such as 2,3-dihydroxybenzoate and methyl 3,5-dihydroxybenzoate, resorcin, gallic acid, dodecyl gallate, ethyl gallate, butyl gallate, propyl gallate, 2,2-bis(4-hydroxyphenyl)propane, 4,4-dihydroxydiphenylsulfone, 1,1-bis(4-hydroxyphenyl)ethane, 2,2-bis(4-hydroxy-3-methylphenyl) propane, bis(4-hydroxyphenyl)sulfide, 1-phenyl-1,1-bis(4-hydroxyphenyl)ethane, 1,1-bis(4-hydroxyphenyl)-3-methylbutane, 1,1-bis(4-hydroxyphenyl)-2-methylpropane, 1,1-bis(4-hydroxyphenyl)-n-hexane, 1,1-bis(4-hydroxyphenyl)-n-heptane, 1,1-bis(4-hydroxyphenyl)-n-octane, 1,1-bis (4-hydroxyphenyl)-n-nonane, 1,1-bis(4-hydroxyphenyl)-n-decane, 1,1-bis(4-hydroxyphenyl)-n-dodecane, 2,2-bis(4-hydroxyphenyl)butane, 2,2-bis(4-hydroxyphenyl)ethyl propionate, 2,2-bis(4-hydroxyphenyl)-4-methylpentane, 2,2-bis(4-hydroxyphenyl)hexafluoropropane, 2,2-bis(4-hydroxyphenyl)-n-heptane 2,2-bis(4-hydroxyphenyl)-n-nonane, 2,4-dihydroxyacetophenone, 2,5-dihydroxyacetophenone, 2,6-dihydroxyacetophenone, 3,5-dihydroxyacetophenone, 2,3,4-trihydroxyacetophenone, 2,4-dihydroxybenzophenone, 4,4'-dihydroxybenzophenone, 2,3,4-trihydroxybenzophenone, 2,4,4'-trihydroxybenzophenone, 2,2',4,4'-tetrahydroxybenzophenone, 2,3,4,4'-tetrahydroxybenzophenone, 2,4'-biphenol, 4,4'-biphenol, 4-[(4-hydroxyphenyl)methyl]-1,2,3-benzenetriol, 4-[(3,5-dimethyl-4-hydroxyphenyl)methyl]-1,2,3-benzenetriol, 4,6-bis[(3,5-dimethyl-4-hydroxyphenyl)methyl]-1,2,3-benzenetriol, 4,4'-[1,4-phenylenebis(1-methylethylidene)bis (benzene-1,2,3-triol)], 4,4'-[1,4-phenylenebis(1-methylethylidene)bis(1,2-benzenediol)], 4,4',4"-ethylidenetrisphenol, 4,4'-(1-methylethylidene)bisphenol, and methylenetris-p-cresol.

The binder resin constituting the toner according to this embodiment is not particularly limited and can be appropriately determined by a person skilled in the art.

As the binder resin, for example, a polyester resin obtained by subjecting a dicarboxylic acid component and a diol component to an esterification reaction followed by polycondensation, or a polystyrene resin can be used.

Among these components, examples of the dicarboxylic acid component include aromatic dicarboxylic acids such as terephthalic acid, phthalic acid, and isophthalic acid; and aliphatic carboxylic acids such as fumaric acid, maleic acid, succinic acid, adipic acid, sebacic acid, glutaric acid, pimelic acid, oxalic acid, malonic acid, citraconic acid, and itaconic acid.

Further, examples of the diol component include aliphatic dials such as ethylene glycol, propylene glycol, 1,4-butanediol, 1,3-butanediol, 1,5-pentanediol, 1,6-hexanediol, neopentyl glycol, trimethylene glycol, trimethylolpropane, and pentaerythritol; alicyclic dials such as 1,4-cyclohexanediol and 1,4-cyclohexanedimethanol; and an ethylene oxide or propylene oxide adduct of bisphenol A or the like.

Further, the above polyester component maybe converted so as to have a crosslinking structure using a trivalent or higher polyvalent carboxylic acid component or a trihydric or higher polyhydric alcohol component such as 1,2,4-benzenetricarboxylic acid (trimellitic acid) or glycerin.

In the toner of this embodiment, two or more kinds of polyester resins having different compositions may be mixed and used.

Further, in the toner of this embodiment, the polyester resin may be crystalline or noncrystalline.

Further, as the polystyrene resin, a polystyrene resin obtained by copolymerization of an aromatic vinyl component and a (meth)acrylic acid ester component is preferred. Examples of the aromatic vinyl component include styrene, a-methylstyrene, o-methylstyrene, and p-chlorostyrene. Examples of the acrylic acid ester component include ethyl acrylate, propyl acrylate, butyl acrylate, 2-ethylhexyl acrylate, butyl methacrylate, ethyl methacrylate, and methyl methacrylate. Among these, butyl acrylate is generally used. As the polymerization method, an emulsion polymerization method is generally employed, and the resin is obtained by radical polymerization of monomers of the respective components in an aqueous phase containing an emulsifying agent.

The glass transition temperatures of the polyester resin and the polystyrene resin are preferably 35° C. or higher and 80° C. or lower, and more preferably 40° C. or higher and 75° C. or lower. If the glass transition temperature is lower than 35° C., the storage stability is decreased as compared with the case where the glass transition temperature is in the above range, and blocking occurs in a developing machine. On the other hand, if the glass transition temperature is higher than 75° C., sufficient fixability cannot be ensured as compared with the case where the glass transition temperature is in the above range.

The weight average molecular weight Mw of the polyester resin is preferably 5000 or more and 30000 or less. On the other hand, the weight average molecular weight Mw of the polystyrene resin is preferably 10000 or more and 70000 or less. If the weight average molecular weight Mw of the polyester resin is less than 5000 (in the case of the polystyrene resin, less than 10000), the heat-resistant storage stability of the toner is decreased as compared with the case where the weight average molecular weight Mw is in the above range. Further, if the weight average molecular weight Mw of the polyester resin is more than 30000 (in the case of the polystyrene resin, more than 70000), the fixing temperature is increased as compared with the case where the weight average molecular weight Mw is in the above range, and therefore, it is not preferred from the viewpoint of suppression of power consumption in a fixing treatment.

In the toner according to this embodiment, other components such as a color erasing agent, a charge control agent, and an external additive may be contained or retained on the outer surface thereof.

The release agent which may be contained in the toner is not particularly limited. Examples thereof include aliphatic hydrocarbon waxes such as low-molecular weight polyethylene, low-molecular weight polypropylene, polyolefin copolymers, polyolefin waxes, microcrystalline waxes, paraffin waxes, and Fischer-Tropsch waxes; oxides of aliphatic hydrocarbon waxes such as polyethylene oxide waxes or block copolymers thereof; vegetable waxes such as candelilla wax, carnauba wax, Japan wax, jojoba wax, and rice wax; animal waxes such as bees wax, lanolin, and whale wax; mineral waxes such as ozokerite, ceresin, and petrolatum; waxes containing, as a main component, a fatty acid ester such as montanic acid ester wax and castor wax; and deoxidation products resulting from deoxidation of a part or the whole of a fatty acid ester such as deoxidized carnauba wax. Further, saturated linear fatty acids such as palmitic acid, stearic acid, montanic acid, and long-chain alkyl carboxylic acids having a longer chain alkyl group; unsaturated fatty acids such as brassidic acid, eleostearic acid, and parinaric acid; saturated alcohols such as stearyl alcohol, eicosyl alcohol, behenyl alcohol, carnaubyl alcohol, ceryl alcohol, melissyl alcohol, and long-chain alkyl alcohols having a longer chain alkyl group; polyhydric alcohols such as sorbitol; fatty acid amides such as linoleic acid amide, oleic acid amide, and lauric acid amide; saturated fatty acid bisamides such as methylenebisstearic acid amide, ethylenebiscaprylic acid amide, ethylenebislauric acid amide, and hexamethylenebisstearic acid amide; unsaturated fatty acid amides such as ethylenebisoleic acid amide, hexamethylenebisoleic acid amide, N,N'-dioleyladipic acid amide, and N,N'-dioleylsebacic acid amide; aromatic bisamides such as m-xylenebisstearic acid amide, and N,N'-distearylisophthalic acid amide; fatty acid metal salts (generally called metallic soaps) such as calcium stearate, calcium laurate, zinc stearate, and magnesium stearate; waxes obtained by grafting of a vinyl monomer such as styrene or acrylic acid on an aliphatic hydrocarbon wax; partially esterified products of a fatty acid and a polyhydric alcohol such as behenic acid monoglyceride, and methyl ester compounds having a hydroxyl group obtained by hydrogenation of a vegetable fat or oil can be exemplified.

The color erasing agent is a substance which is preferentially compatible with the color developing agent and therefore has an action of erasing a color by reducing the interaction between the color former compound and the color developing agent, and a known substance can be used in this embodiment. The color of the toner according to this embodiment can be erased by heating even if the toner does not contain a color erasing agent, however, by incorporating the color erasing agent, a color erasing treatment can be more promptly performed. The color erasing agent can be, for example, configured to be incorporated in the below-mentioned coloring agent fine particles in the toner particles.

For example, the color erasing agent can be used in such a manner that the component (coloring agent) in a color developed state resulting from binding the color former compound and the color developing agent and a color erasing component are dispersed in a medium which has low or no color developing and erasing actions (hereinafter referred to as "color erasing agent of a first embodiment"). Further, the color erasing agent may be such that the color erasing component is used as a medium for the coloring agent (hereinafter referred to as "color erasing agent of a second embodiment").

As the color erasing agent of the first embodiment, a color erasing agent known in JP-A-2000-19770 or the like can be used. Examples thereof include cholesterol, stigmasterol, pregnenolone, methylandrostenediol, estradiol benzoate, epiandrostene, stenolone, β-sitosterol, pregnenolone acetate, β-chorestanol, 5,16-pregnadiene-3β-ol-20-one, 5α-pregnen-3β-ol-20-one, 5-pregnen-3β, 17-diol-20-one-21-acetate, 5-pregnen-3β, 17-diol-20-one-17-acetate, 5-pregnen-3β, 21-diol-20-one-21-acetate, 5-pregnen-3β, 17-diol diacetate, rockogenin, thigogenin, esmiragenin, heckogenin, diosgenin, cholic acid, methyl cholate, sodium cholate, lithocholic acid, methyl lithocholate, sodium lithocholate, hydroxycholic acid, methyl hydroxycholate, hyodeoxycholic acid, methyl hyodeoxycholate, testosterone, methyltestosterone, 11α-hydroxymethyltestosterone, hydrocortisone, cholesterol methyl carbonate, α-cholestanol, D-glucose, D-mannose, D-galactose, D-fructose, L-sorbose, L-rhamnose, L-fucose, D-ribodesose, α-D-glucose pentaacetate, acetoglucose, diacetone-D-glucose, D-glucuronic acid, D-galacturonic acid, D-glucosamine, D-fructosamine, D-isosaccharic acid, vitamin C, erutorubic acid, trehalose, saccharose, maltose, cellobiose, gentiobiose, lactose, melibiose, raffinose, gentianose, melizitose, stachyose, methyl α-glucopyranoside, salicin, amygdalin, euxanthic acid, cyclododecanol, hexahydrosalicylic acid, menthol, isomenthol, neomenthol, neoisomenthol, carbomenthol, α-carbomenthol, piperithol, α-terpineol, β-terpineol, γ-terpineol, 1-p-menthene-4-ol, isopulegol, dihydrocarveol, carveol, 1,4-cyclohexanediol, 1,2-cyclohexanediol, phloroglucitol, quercitol, inositol, 1,2-cyclododecanediol, quinic acid, 1,4-terpene, 1,8-terpene, pinol hydrate, betulin, borneol, isoborneol, adamantanol, norborneol, fenchol, camphor, and 1,2;5,6-diisopropylidene-D-mannitol.

As the color erasing agent of the second embodiment, particularly, a color developing and erasing mechanism utilizing the thermal hysteresis of a known color erasing agent disclosed in JP-A-60-264285, JP-A-2005-1369, JP-A-2008-280523, or the like has an excellent instantaneous erasing property. When a mixture of such a three-component system in a color developed state is heated to a specific color erasing temperature (Th) or higher, the color can be erased. Further, even if the mixture in a decolor state is cooled to a temperature of Thor lower, the decolor state is maintained. When the temperature of the mixture is further decreased, a color developing reaction between the leuco dye and the color developing agent is restored at a specific color restoring temperature Tc or lower to return to the color developed state, whereby it is possible to cause a reversible color developing and erasing reaction. In particular, it is preferred that the color erasing agent to be used in this embodiment satisfies the following relationship: Th>Tr>Tc, wherein Tr represents room temperature.

Examples of the color erasing agent capable of causing this thermal hysteresis include an alcohol, an ester, a ketone, an ether, and an acid amide.

Particularly preferred is an ester. Specific examples thereof include an ester of a carboxylic acid containing a substituted aromatic ring, an ester of a carboxylic acid containing an unsubstituted aromatic ring with an aliphatic alcohol, an ester of a carboxylic acid containing a cyclohexyl group in the molecule, an ester of a fatty acid with an unsubstituted aromatic alcohol or a phenol, an ester of a fatty acid with a branched aliphatic alcohol, an ester of a dicarboxylic acid with an aromatic alcohol or a branched aliphatic alcohol, dibenzyl cinnamate, heptyl stearate, didecyl adipate, dilauryl adipate, dimyristyl adipate, dicetyl adipate, distearyl adipate, trilaurin, trimyristin, tristearin, dimyristin, and distearin. These may be used by mixing two or more of them.

As the charge control agent, a metal-containing azo compound is used, and the metal element is preferably a complex or a complex salt of iron, cobalt or chromium or a mixture thereof. Further, as the charge control agent, a metal-containing salicylic acid derivative compound can also be used. In the case of using such a metal-containing salicylic acid derivative compound, the metal element is preferably a complex or a complex salt of zirconium, zinc, chromium, or boron, or a mixture thereof. By incorporating the charge control agent, a frictional charge quantity can be controlled.

Further, as the external additive, for example, in order to adjust the fluidity or chargeability, inorganic fine particles can be externally added and mixed in an amount of from 0.01 to 20% by mass based on the total mass of the toner particles. As such inorganic fine particles, silica, titania, alumina, strontium titanate, tin oxide, and the like can be used alone or by mixing two or more of them. It is preferred that as the inorganic fine particles, those surface-treated with a hydrophobizing agent are used from the viewpoint of improvement of environmental stability. Further, other than such inorganic oxides, resin fine particles having a size of 1 μm or less may be externally added for improving the cleaning property.

Figure 2:
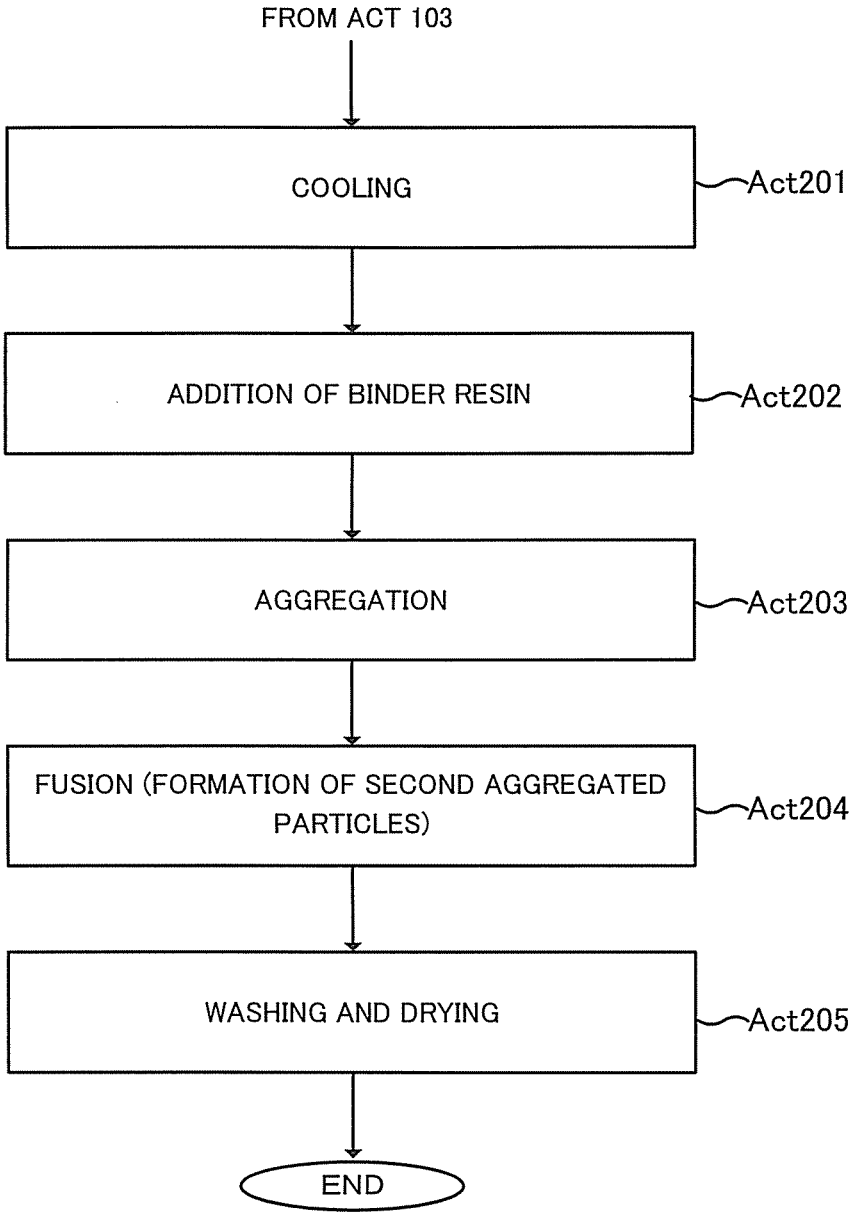
FIG. 2 is a process flow chart according to one example of a method for producing a toner of an embodiment.

Subsequently, steps in the method for producing a toner of this embodiment will be described as an example with reference to the flow chart shown in FIGS. 1 and 2.

As shown below, in this embodiment, a toner is produced through a step of preparing first aggregated particles by aggregating and fusing fine particles containing a color former compound, a color developing agent, and a binder resin and a step of preparing second aggregated particles by aggregating and fusing the first aggregated particles and a binder resin.

The toner according to this embodiment has a mechanism of developing a color by reacting the color former compound and the color developing agent. This reaction is a reversible reaction, and therefore, in order to develop a color, it is preferred that the color developing agent is present in the vicinity of the color former compound under a condition where the color developing agent can react with the color former compound at any time. Therefore, according to the production method of this embodiment, since the color former compound and the color developing agent are in a state where these two components are non-uniformly dispersed in the toner particles and are present in the vicinity of each other, a developer can be produced without decreasing the developed color density.

In Act 101, first, particles of a mixture containing a color former compound, a color developing agent, and a binder resin are formed, and then, the resulting particles are finely pulverized, whereby fine particles containing the color former compound, the color developing agent, and the binder resin are formed. The fine pulverization can be performed by, for example, subjecting a dispersion medium containing the particles of the mixture to mechanical shearing, thereby finely pulverizing the particles to form fine particles having a particle diameter smaller than that of the particles of the mixture. Further, in this embodiment, by applying heat in the course of these steps, the color former compound and the color developing agent are bound to each other to develop a color, whereby a coloring agent is formed.

In this specification, the fine particles containing the coloring agent obtained by this step and the binder resin, in other words, the fine particles containing the color former compound, the color developing agent, and the binder resin are referred to as "coloring agent-containing fine particles".

Here, a specific example of the preparation method using a high-pressure pulverizer as one of the mechanical emulsification methods will be described as one example of the mechanical shearing.

First, particles containing a color former compound, a color developing agent, and a binder resin are prepared.

In this embodiment, the color former compound, the color developing agent, and the binder resin are melt-kneaded at a temperature at which a color is not developed using, for example, a kneader, and then, the resulting mixture is crushed, whereby particles are obtained.

The particles have a volume average particle diameter (volume D50) of preferably from 0.1 mm to 2 mm, more preferably from 0.02 mm to 1 mm. If the volume average particle diameter is less than 0.01 mm, strong stirring is required for dispersing the particles in an aqueous medium, and foam generated by stirring tends to decrease the dispersion of the particles of the mixture. Meanwhile, if the volume average particle diameter exceeds 2 mm, the particle diameter is larger than a gap provided in a shearing part, and therefore, the particles are caught in the shearing part or a difference in the applied energy is generated between the inner portion and the outer portion of the mixture, therefore, particles having an uneven composition or an uneven particle diameter tend to be formed.

Incidentally, in this specification, the volume average particle diameter (volume D50) refers to the particle diameter of a particle the value of which is arrived at when the cumulative volume distribution of the particles reaches 50% determined from the sum of the volumes of the individual particles calculated from the particle diameters. Hereinafter, the volume average particle diameter (volume D50) is referred to simply as "volume average particle diameter" or "volume D50".

The volume average particle diameter can be determined using, for example, Multisizer 3 (aperture diameter: 100 μm, manufactured by Beckman Coulter, Inc.)

Subsequently, the obtained particles are dispersed in a dispersion medium which is an aqueous medium, whereby a dispersion liquid of the mixture containing the color former compound, the color developing agent, and the binder resin.

In the step of forming the dispersion liquid, a surfactant and/or an alkaline pH adjusting agent can be added to the dispersion medium.

By the addition of a surfactant, due to the action of the surfactant adsorbed onto the surfaces of the particles, the particles of the mixture containing the color former compound, the color developing agent, and the binder resin can be easily dispersed in the dispersion medium.

At this time, the concentration of the surfactant is preferably the critical micelle concentration thereof or higher. Here, the critical micelle concentration refers to the minimum concentration of a surfactant necessary for forming micelles in water and can be determined by measuring the surface tension or electrical conductivity. When the surfactant is contained at a critical micelle concentration or higher, the particles of the mixture are more easily dispersed.

On the other hand, by the addition of an alkaline pH adjusting agent, the degree of dissociation of a dissociative functional group on the surface of the binder resin contained in the mixture is increased or the polarity is increased, and therefore, the self-dispersibility can be improved.

Incidentally, if foam is generated, in order to prevent the occurrence of apparatus failure during the processing in the subsequent fine pulverization treatment, the foam in the dispersion liquid may be removed as needed.

Subsequently, the particles are subjected to, for example, mechanical shearing in the dispersion medium to form fine particles, and the resulting fine particles are dispersed in a dispersion medium, whereby a dispersion liquid is prepared.

Figure 3:
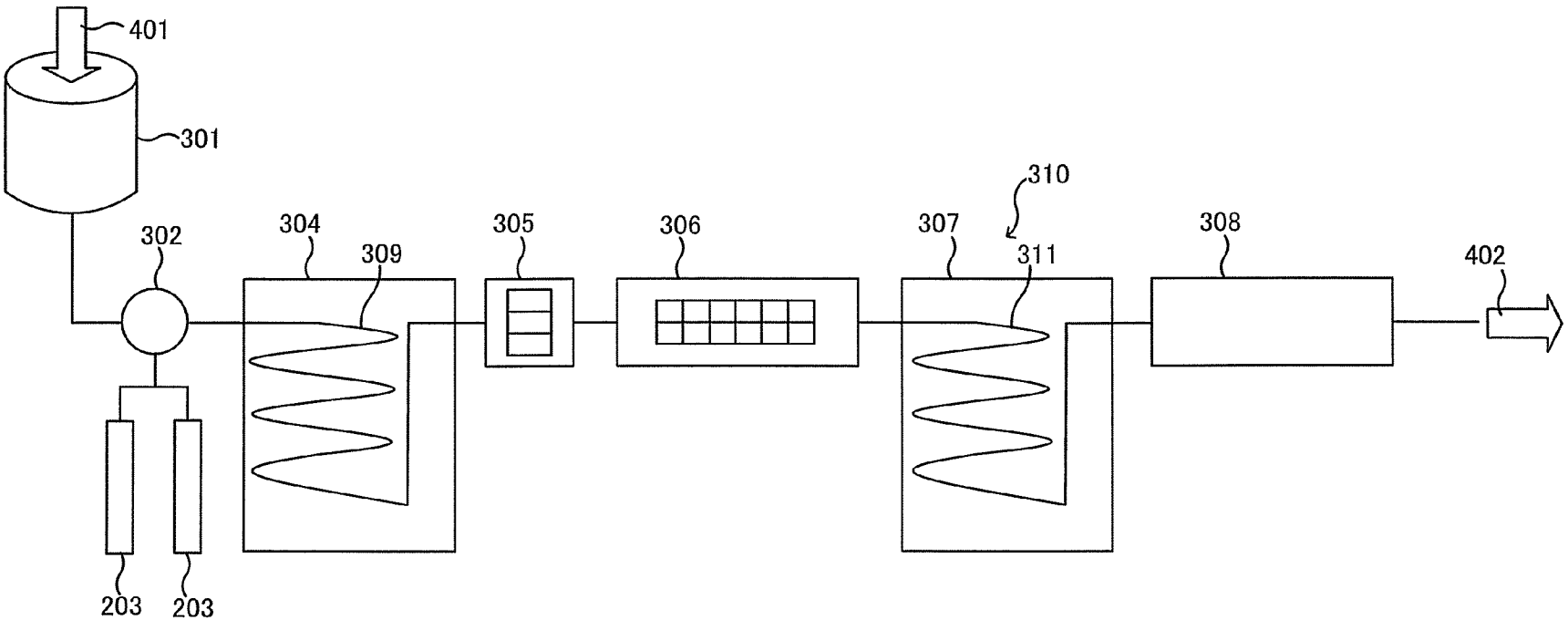
FIG. 3 is a schematic view showing a structure of a high-pressure pulverizer.

One example of a schematic view of a high-pressure pulverizer in this embodiment is shown in FIG. 3.

The high-pressure pulverizer is a device configured to apply a shearing force by allowing a material to pass through a fine nozzle while applying a pressure of from 10 MPa to 300 MPa by means of a high-pressure pump to pulverize the material into fine particles.

As shown in FIG. 3, a high-pressure pulverizer 310 has a configuration in which a hopper tank 301, a liquid feed pump 302, a high-pressure pump 203, a heating unit 304, a pulverizing unit 305, a pressure reducing unit 306, a cooling unit 307, and a pressure reducing unit 308 are arranged in this order, and includes pipes which connect the respective units.

The hopper tank 301 is a tank in which a process liquid (the dispersion liquid according to this embodiment) is fed. While the device is being operated, it is necessary to always fill the tank with a liquid so as not to send air into the device. When the particles in the dispersion liquid have a large particle diameter and are likely to precipitate, a stirrer can be further installed in the tank.

The liquid feed pump 302 is installed for continuously feeding the process liquid to the high-pressure pump 203. Further, this liquid feed pump 302 is also effective in avoiding clogging of a check valve (not shown) installed in the high-pressure pump 203. As the liquid feed pump 302, for example, a diaphragm pump, a tubing pump, a gear pump, or the like can be used.

The high-pressure pump 203 is a plunger pump and has check valves at a process liquid inlet port (not shown) and a process liquid outlet port (not shown). The number of plungers varies depending on the production scale, and 1 to 10 plungers are used. In order to reduce a pulsating current as much as possible, it is preferred that two or more plungers are used.

The heating unit 304 is provided with a high-pressure pipe 309 formed in a spiral shape so as to have a large heat exchange area in a heating device such as an oil bath. It does not matter whether this heating unit 304 is installed in the upstream side or downstream side of the high-pressure pump 203 in the flow direction of the dispersion liquid, however, it is necessary to install this heating unit 304 at least in the upstream side of the pulverizing unit 305. When the heating unit 304 is installed in the upstream side of the high-pressure pump 203, a heating device may be installed in the hopper tank 301, however, the time in which the process liquid is retained at a high temperature is long, and therefore, the binder resin is liable to be hydrolyzed.

The pulverizing unit 305 includes a nozzle having a small diameter for applying a strong shearing force. The diameter and shape of the nozzle vary, however, the diameter thereof is preferably from 0.05 mm to 0.5 mm, and as for the shape thereof, a pass-through type nozzle or a collision type nozzle is preferred. Further, this nozzle may be configured in a multiple-stage structure. When a multiple-stage structure is employed, a plurality of nozzles having different diameters may be arranged. As for the configuration of the arrangement of such nozzles, either a series or parallel configuration may be employed. As the material of the nozzle, diamond or the like which can withstand high pressure is used.

The cooling unit 307 is provided with a pipe 311 formed in a spiral shape so as to have a large heat exchange area in a bath in which cold water is allowed to continuously flow.

According to need, pressure reducing units 306 and 308 can be installed in the upstream and downstream of the cooling unit 307. The pressure reducing units 306 and 308 have a structure in which one or more cells or two-way valves having a flow path that is larger than the diameter of the nozzle of the pulverizing unit 307 and smaller than the diameter of the pipe connected thereto are arranged.

Specific examples of the high-pressure pulverizer include Nanomizer (manufactured by Yoshida Kikai Co. Ltd.), Altimizer (manufactured by Sugino Machine Limited), NANO 3000 (manufactured by Beryu Co., Ltd.), Microfluidizer (manufactured by Mizuho Industry Co., Ltd.), and Homogenizer (manufactured by Izumi Food Machinery Co., Ltd.).

The treatment using this high-pressure pulverizer is performed as follows.

First, the process liquid is heated. This heating is performed for melting the binder resin and also for forming a coloring agent by binding the color former compound and the color developing agent to each other to develop a color.

The heating temperature at this time can be set to a temperature at which the color development is initiated or a temperature at which the color former compound is thermally decomposed, and also can be set in consideration of the melting characteristics of the binder resin or the like. When the binder resin is easy to melt, the heating temperature may be set to low, however, when the binder resin is difficult to melt, the heating temperature should be set to high. Further, in the case of using a method of heating the dispersion liquid by allowing the liquid to continuously pass through the heat exchanger, the flow rate of the dispersion liquid and the length of the pipe of the heat exchanger also have an influence on the heating temperature. When the flow rate is high or the length of the pipe is small, a high temperature is needed. Meanwhile, when the flow rate is low or the length of the pipe is large, the dispersion liquid is sufficiently heated, therefore, it is possible to perform the treatment at a low temperature. For example, when the flow rate is from 300 to 400 cc/min, the heat exchange pipe is a high-pressure pipe having a diameter of ⅜ inch and a length of 12 m, the glass transition temperature Tg of the binder resin is 60° C., and the softening point Tm of a toner is 130° C., the heating temperature can be set to, for example, 100° C. to 200° C. The measurement of the softening point of a toner is performed by a temperature raising method using Flow Tester CFT-500 manufactured by Shimadzu Corporation, and the point on a curve which corresponds to a descent amount of the plunger of 2 mm on the flow chart is taken as the softening point.

Subsequently, the particles in the heated dispersion liquid are subjected to shearing under application of a pressure of 10 MPa or more. Specifically, the particles are subjected to shearing by the nozzle installed in the high-pressure pulverizer. By allowing the dispersion liquid to pass through the nozzle under application of a high pressure of 10 MPa or more, the particles in the dispersion liquid are finely pulverized. The pressure at this time can be set to 10 MPa to 300 MPa.

Finally, the dispersion liquid is cooled to the glass transition temperature Tg of the binder resin or lower. By this cooling, the molten fine particles are solidified. Since the process liquid is rapidly cooled, aggregation or coalescence due to cooling is difficult to occur.

According to need, application of back-pressure or reduction in pressure may be performed in the upstream or downstream of the cooling unit. The application of back-pressure or reduction in pressure is performed for returning the pressure after the process liquid passes through the nozzle to a pressure close to atmospheric pressure in a single step (by application of back-pressure) or in multiple steps (by reduction in pressure) so as not to release the process liquid to atmospheric pressure immediately after the process liquid passes through the nozzle. The pressure after passing through a back-pressure applying unit or a pressure reducing unit is from 0.1 MPa to 10 MPa, preferably from 0.1 MPa to 5 MPa. It is more preferred that in this pressure reducing unit, a plurality of cells or valves with different diameters are arranged. By reducing the pressure in multiple steps, few coarse particles are generated and fine particles having a sharp particle size distribution can be obtained.

As described above, a dispersion liquid in which the fine particles containing the coloring agent and the binder resin are dispersed in the dispersion medium is obtained.

The volume average particle diameter of the thus obtained coloring agent-containing fine particles is not particularly limited, but can be set to, for example 50 to 1500 nm.

Subsequently, the coloring agent-containing fine particles in the obtained dispersion liquid are aggregated (Act 102). Then, the aggregated coloring agent-containing fine particles are fused, whereby first aggregated particles are obtained (Act 103).

In Act 102, first, an aggregating agent is added to the dispersion liquid of coloring agent-containing fine particles. Then, the dispersion liquid is heated, whereby the coloring agent-containing fine particles are aggregated. The kind of the aggregating agent and the addition amount thereof can be appropriately determined by a person skilled in the art according to the kinds of the color former compound, color developing agent, binder resin, and other components, the dispersion stability of the coloring agent-containing fine particles, the particle diameter of the first aggregated particles obtained after fusing, and the like. Further, the heating temperature when aggregating the particles can also be appropriately determined by a person skilled in the art according to the kinds of the color former compound, color developing agent, binder resin, and other components.

As the aggregating agent, for example, a monovalent salt such as sodium chloride, potassium chloride, lithium chloride, or sodium sulfate; a divalent salt such as magnesium chloride, calcium chloride, magnesium sulfate, calcium nitrate, zinc chloride, ferric chloride, or ferric sulfate; or a trivalent salt such as aluminum sulfate or aluminum chloride can be used. Further, an organic coagulating agent or an organic polymeric aggregating agent, for example, a quaternary ammonium salt such as polyhydroxy propyldimethyl ammonium chloride or polydiallyl dimethyl ammonium chloride can be used.

Subsequently, the aggregated coloring agent-containing fine particles are fused by increasing the fluidity of the binder resin through heating, whereby first aggregated particles are prepared.

The heating temperature when fusing the aggregated particles can be determined according to the kind of the binder resin used (specifically, the glass transition temperature Tg of the binder resin used). More specifically, the temperature can be appropriately determined in a range from the glass transition temperature of the binder resin to the color erasure initiation temperature (a temperature at which the color former compound and the color developing agent bound to each other are separated from each other to initiate erasure of the color) of the coloring agent.

Incidentally, when another component such as a color erasing agent is incorporated, such a component may be mixed, for example, in the step of mixing the color former compound, the color developing agent, and the binder resin or in the step of aggregating the particles of the mixture.

Further, aggregation and fusion may sometimes be performed simultaneously according to the kind of the fine particles, the concentration of the solid content in the fine particles, or the kind of the aggregating agent.

Subsequently, the process proceeds to Act 201, in which the dispersion liquid containing the first aggregated particles obtained by the fusion treatment is cooled. Here, it is preferred to cool the dispersion liquid to a temperature not higher than the glass transition temperature (Tg) of the binder resin contained in the first aggregated particles plus 10° C. (hereinafter referred to as "upper limit cooling temperature") in the cooling treatment. In the case of cooling to a temperature not higher than the upper limit cooling temperature, the viscosity of the resin is increased when the binder resin and the first aggregated particles are aggregated in the below-mentioned aggregation treatment, and therefore, the progression of aggregation can be retarded as compared with the case where the dispersion liquid is not cooled to a temperature not higher than the upper limit cooling temperature. Accordingly, coarse particles having a volume average particle diameter of 15 μm or more and the components to be contained in the toner can be more uniformly aggregated as compared with the case where the dispersion liquid is not cooled to a temperature not higher than the upper limit cooling temperature. As a result, the quality of an image formed can be increased as compared with the case where the dispersion liquid is not cooled to a temperature not higher than the upper limit cooling temperature.

More specifically, when a resin is heated to a temperature not lower than Tg, the movement of the molecules of the resin becomes active and the resin becomes flowable, whereby the viscoelasticity thereof decreases. By cooling the dispersion liquid to a temperature not higher than the upper limit cooling temperature, the decrease in the viscoelasticity can be prevented, and therefore, even if the toner particles collide with each other during stirring, the particles rebound from each other and are less likely to aggregate. As a result, the generation of coarse particles can be prevented, and therefore, the progression of aggregation can be retarded. Further, the state of dispersion of coarse particles and the components contained in the toner can be made more uniform, and therefore, the quality of an image formed can be increased.

Incidentally, the lower limit of the temperature after the cooling treatment is not particularly limited, however, in consideration of the manufacturability, it can be set to, for example, 20° C. or higher.

Subsequently, to the dispersion liquid containing the first aggregated particles after the cooling treatment, a binder resin is added (Act 202). At this time, a release agent is also added as needed. Then, the first aggregated particles and the added binder resin are aggregated (Act 203) and fused (Act 204), whereby second aggregated particles are obtained.

The binder resin to be added in Act 202 may be the same as or different from the binder resin contained in the first aggregated particles.

The addition of the binder resin can be performed by, for example, mixing a dispersion liquid of fine particles containing the binder resin in the dispersion liquid containing the first aggregated particles. Incidentally, in this specification, the fine particles containing the binder resin are referred to as "resin fine particles" for the sake of being distinguished from the coloring agent-containing fine particles.

A method for preparing the resin fine particles is not particularly limited, and for example the resin fine particles can be prepared using a melt-kneading method.

Further, as another example, the resin fine particles can be prepared by a method using the above-mentioned high-pressure pulverizer.

As still another example, the resin fine particles can also be prepared by using an emulsion polymerization method.

In the case of using an emulsion polymerization method, first, an oil phase component in which a polymerizable vinyl monomer and optionally a chain transfer agent are mixed is prepared. Then, the oil phase component is emulsified and dispersed in an aqueous phase component which is an aqueous surfactant solution. Then, a water-soluble polymerization initiator is added thereto, and polymerization is initiated by heating the resulting mixture. In the oil phase component, a toner component such as a release agent or a charge control agent may be mixed. Further, if necessary, a dispersion in which fine particles containing a release agent, a charge control agent, or the like are dispersed in an aqueous medium is added during polymerization, whereby such a component can be incorporated into the emulsion polymerized particles. By this emulsion polymerization, fine particles containing a binder resin having a volume average particle diameter of, for example, from 0.01 to 1 μm can be prepared. In this emulsion polymerization method, polymerization may be performed while adding the oil phase component dropwise to the aqueous phase component, or the polymerization initiator may be added again during polymerization for adjusting the molecular weight.

Further, as another example, the resin fine particles can also be prepared using a phase inversion emulsification method.

In the case of using a phase inversion emulsification method, first, an oil phase component containing at least a binder resin is melted by heating. Then, an aqueous solution containing a surfactant and a pH adjusting agent is gradually added thereto. By adding the aqueous solution thereto, the phase is inverted from W/O to O/W. After completion of phase inversion, the resulting mixture is cooled, whereby fine particles containing at least a binder resin and having a size of from 0.01 to 5 μm can be prepared. To the oil phase component, a surfactant, a pH adjusting agent, a solvent, ion exchanged water, or the like may be added in advance. In particular, in the case of adding a solvent, the viscosity of the oil phase component is decreased, therefore, it is not necessary to perform heating in some cases. However, if a solvent is used, it is necessary to remove the solvent after completion of phase inversion emulsification.

Subsequently, in Act 203, the first aggregated particles and the resin fine particles in the dispersion liquid are aggregated. Specifically, an aggregating agent is added to the dispersion liquid, and the resulting mixture is heated to effect aggregation. The kind and addition amount of the aggregating agent and the heating temperature can be appropriately determined by a person skilled in the art in the same manner as the aggregation treatment in the process of the formation of the first aggregated particles.

Subsequently, the fluidity of the binder resin is increased by heating, and the aggregated first aggregated particles and resin fine particles are fused, whereby second aggregated particles are prepared (Act 204).

The heating temperature in the fusion treatment can also be appropriately determined by a person skilled in the art in the same manner as the case of the formation of the first aggregated particles.

Incidentally, the size of the second aggregated particles is not particularly limited.

Subsequently, in Act 205, the obtained second aggregated particles are washed and dried, whereby a toner is prepared. To the prepared toner, an external additive is externally added as needed.

Here, in this embodiment, it is preferred that the volume average particle diameter of the first aggregated particles and the volume average particle diameter of the second aggregated particles are controlled such that the following relationship (1) is satisfied:

$$m/n = 0.05 \text{ to } 0.5 \quad (1)$$

wherein m represents the volume average particle diameter of the first aggregated particles and n represents the volume average particle diameter of the second aggregated particles.

If the value of m/n is smaller than 0.05, it is difficult to incorporate the coloring agent into the first aggregated particles with a uniform composition as compared with the case where the value is in the above range, and therefore, the color developing property deteriorates. Further, if the value is larger than 0.5, it becomes difficult to incorporate the first aggregated particles into the second aggregated particles with a uniform composition, and therefore, the image quality deteriorates.

Further, in this embodiment, the volume average particle diameter of the toner particles obtained after washing and drying is preferably 3 μm or more and 15 μm or less. If the volume average particle diameter is more than 15 μm, the image quality is liable to deteriorate as compared with the case where the volume average particle diameter is in the above range. Further, if the volume average particle diameter is less than 3 μm, the handling property of the toner deteriorates as compared with the case where the volume average particle diameter is in the above range.

Incidentally, the volume average particle diameters of the first aggregated particles, the second aggregated particles, and the toner particles can be controlled by adjusting the amount of a component such as a binder resin to be added in the course of the preparation of the first aggregated particles or the second aggregated particles, the amount of the aggregating agent, the aggregation temperature, or the like.

The sizes of the first aggregated particles and the second aggregated particles are not particularly limited and can be appropriately determined by a person skilled in the art.

Incidentally, the proportions of the respective components to be contained in the toner can be appropriately determined by a person skilled in the art, however, the toner can be formed in the following proportions: 100 parts by mass of the color former compound; 30 to 300 parts by mass of the color developing agent; and 300 to 2000 parts by mass of the binder resin.

In addition, the content of the coloring agent to be contained in the toner is adjusted to preferably 50% by mass or less, more preferably 30% by mass or less. If the content thereof is more than 50% by mass, the degree of the erasure of an image after the color erasing treatment is performed is decreased as compared with the case where the content thereof is 50% by mass or less.

The toner obtained by the method for producing a toner according to this embodiment is mixed with a carrier in the same manner as a common toner and is prepared as a developer. The thus prepared developer is placed in, for example, an image forming apparatus such as multifunction peripheral (MFP) and is used for forming an image onto a recording medium.

In the image formation step, as a result of heating a toner image formed using the toner according to this embodiment and transferred onto a recording medium at a fixing temperature, the resin is melted and penetrates into the recording medium, and thereafter, the resin is solidified, thereby forming an image on the recording medium (fixing treatment).

Further, the image formed on the recording medium can be erased by performing a decoloring treatment for the toner. Specifically, the color erasing treatment can be performed by heating the recording medium on which the image is formed at a heating temperature not lower than the color erasure initiation temperature.

Hereinabove, the method for producing a toner according to this embodiment is described, however, it is a matter of course that another embodiment can also be employed. For example, the first aggregated particles may be encapsulated by being covered with an outer shell (shell material), and the encapsulated first fine particles and a binder resin are aggregated and fused, thereby forming the second fine particles.

When the first fine particles have a capsule structure, the toner can be configured such that the toner particles have a first region in which the color former compound and the color developing agent are present in a densely aggregated state, and a second region which is present around the first region and in which the binder resin is contained but the color former compound and the color developing agent are not present.

Incidentally, the second region is not limited to the embodiment in which the color former compound and the color developing agent are not present in the second region, and the color former compound and the color developing agent may be present in the second region in a less densely aggregated state than in the first region. In other words, the second region may be configured such that the color former compound and the color developing agent are present in the second region in a more scattered manner than in the first region.

Further, the embodiment in which the first region and the second region are separated from each other is not limited to encapsulation of the first aggregated particles, and the first region and the second region may be separated by another method.

Further, the condition that the color former compound and the color developing agent are present in the first region in a densely aggregated state can be, in other words, a condition that the diffusion of the color former compound and the color developing agent to the outside of a predetermined range is limited in a specific region in the toner particles.

In addition, in the first region or the second region, the color erasing agent may be incorporated.

EXAMPLES

Subsequently, the method for producing a toner of this embodiment will be described with reference to Examples. However, the invention is by no means limited to the following Examples.

First, the preparation of a dispersion liquid of coloring agent-containing fine particles and a dispersion liquid of resin fine particles will be described.

Preparation of Dispersion Liquid of Coloring Agent-Containing Fine Particles (1)

62.5 Parts by mass of a polyester resin A as a binder resin, 12.5 parts by mass of CVL as a color former compound, and 25 parts by mass of bisphenol A as a color developing agent were mixed, and the resulting mixture was melt-kneaded using a twin-screw kneader set to a temperature of 120° C., whereby a kneaded material was obtained.

The obtained kneaded material was coarsely crushed to a volume average particle diameter of 1.2 mm using a hammer mill manufactured by Nara Machinery Co., Ltd., whereby coarse particles were obtained. Then, the coarse particles were moderately crushed to a volume average particle diameter of 0.05 mm using a Bantam mill manufactured by Hosokawa Micron Corporation, whereby moderately crushed particles were obtained. 40 Parts by mass of the obtained moderately crushed particles, 0.4 parts by mass of sodium dodecylbenzene sulfonate as an anionic surfactant, 1 part by mass of triethylamine as an amine compound, and 58.6 parts by mass of ion exchanged water were processed at 160 MPa and 180° C. using NANO 3000 in the dispersion liquid into fine particles. Further, by heating the material in the NANO 3000, CVL and bisphenol were bound to each other to develop a color (formation of a coloring agent). After the dispersion liquid was cooled in a freezer, the cooled material was left at room temperature as such, whereby a dispersion liquid of coloring agent-containing fine particles colored in blue having a volume average particle diameter of 300 nm was obtained.

Hereinafter, the obtained dispersion liquid of coloring agent-containing fine particles (1) is also referred to as simply "dispersion liquid (1)".

Preparation of Dispersion Liquid of Coloring Agent-Containing Fine Particles (2)

A dispersion liquid of coloring agent-containing fine particles was prepared in the same manner as the dispersion liquid (1) except that 10 parts by mass of CVL as a color former compound, 20 parts by mass of bisphenol A as a color developing agent, 0.1 parts by mass of sodium dodecylbenzene sulfonate as an anionic surfactant, and 69.9 parts by mass of ion exchanged water were used. The obtained coloring agent-containing fine particles had a volume average particle diameter of 150 nm.

Hereinafter, the obtained dispersion liquid of coloring agent-containing fine particles (2) is also referred to as simply "dispersion liquid (2)".

Preparation of Dispersion Liquid of Resin Fine Particles (3)

27 Parts by mass of a polyester resin B as a binder resin, 3 parts by mass of an ester wax as a release agent, 0.3 parts by mass of sodium dodecylbenzene sulfonate as an anionic surfactant, and 1 part by mass of triethylamine as an amine compound were added to 69.7 parts by mass of ion exchange water, and the resulting mixture was processed at 160 MPa and 150° C. using NANO 3000 into fine particles. The obtained resin fine particles had a volume average particle diameter of 250 nm.

Hereinafter, the obtained dispersion liquid of resin fine particles (3) is also referred to as simply "dispersion liquid (3)".

Preparation of Dispersion Liquid of Resin Fine Particles (4)

30 Parts by mass of a polyester resin A as a binder resin, 0.3 parts by mass of sodium dodecylbenzene sulfonate as an anionic surfactant, and 1 part by mass of triethylamine as an amine compound were added to 69.7 parts by mass of ion exchange water, and the resulting mixture was processed at 160 MPa and 150° C. using NANO 3000 into fine particles. The obtained resin fine particles had a volume average particle diameter of 250 nm.

Hereinafter, the obtained dispersion liquid of resin fine particles (4) is also referred to as simply "dispersion liquid (4)".

The above polyester resin A is a polyester resin having a Tg of 60° C., a softening point (Tm) of 101° C., and a molecular weight (Mw) of 6800; and the above polyester resin B is a polyester resin having a Tg of 50+ C., a softening point (Tm) of 90+ C., and a molecular weight (Mw) of 7800.

Example 1

First Aggregation and Fusion Step

To 15 parts by mass of the above-prepared dispersion liquid (2) and 45 parts by mass of the above-prepared dispersion liquid (4), 25 parts by mass of ion exchanged water was added and mixed. As an aggregating agent, 15 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 1.19 μm were obtained.

Incidentally, the volume D50 was measured using Multisizer 3 manufactured by Beckman Coulter, Inc. The same shall apply to the other Examples, and the description is omitted.

Second Aggregation and Fusion Step

To 36 parts by mass of the dispersion liquid containing the above-prepared first aggregated particles cooled to 30° C. and 18 parts by mass of the above-prepared dispersion liquid (3), 36 parts by mass of ion exchanged water was added and mixed. As an aggregating agent, 10 parts by mass of a 10% by mass aqueous sodium chloride solution was added thereto at 30° C., and the temperature of the resulting mixture was raised to 75° C. Then, the mixture was left as such for 2 hours, whereby second aggregated particles having a volume D50 of 5.13 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 5.10 μm.

Example 2

First Aggregation and Fusion Step

To 40 parts by mass of the above-prepared dispersion liquid (1), 45 parts by mass of ion exchanged water was added and mixed. As an aggregating agent, 15 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 1.26 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 40 parts by mass of ion exchanged water was added and mixed. As an aggregating agent, 10 parts by mass of a 10% by mass aqueous sodium chloride solution was added thereto at 30° C., and the temperature of the resulting mixture was raised to 75° C. Then, the mixture was left as such for 2 hours, whereby second aggregated particles having a volume D50 of 5.41 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 5.46 μm.

Example 3

First Aggregation and Fusion Step

To 20 parts by mass of the above-prepared dispersion liquid (1), 75 parts by mass of ion exchanged water was added and mixed. As an aggregating agent, 5 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 0.59 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 35 parts by mass of ion exchanged water was added and mixed. As an aggregating agent, 5 parts by mass of a 5% by mass aqueous aluminum sulfate solution was added thereto at 30° C., and the temperature of the resulting mixture was raised to 40° C. Then, the mixture was left as such for 1 hour. Thereafter, 10 parts by mass of a 10% by mass aqueous polycarboxylic acid sodium salt solution was added thereto, and the temperature of the resulting mixture was raised to 70° C. Then, the mixture was left as such for 1 hour, whereby second aggregated particles having a volume D50 of 12.50 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 12.48 μm.

Example 4

First Aggregation and Fusion Step

To 20 parts by mass of the above-prepared dispersion liquid (1), 73 parts by mass of ion exchanged water was added and mixed. As an aggregating agent, 7 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 0.87 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 35 parts by mass of ion exchanged water was added and mixed. As an aggregating agent, 5 parts by mass of a 5% by mass aqueous aluminum sulfate solution was added thereto at 30° C., and the temperature of the resulting mixture was raised to 40° C. Then, the mixture was left as such for 1 hour. Thereafter, 10 parts by mass of a 10% by mass aqueous polycarboxylic acid sodium salt solution was added thereto, and the temperature of the resulting mixture was raised to 70° C. Then, the mixture was left as such for 1 hour, whereby second aggregated particles having a volume D50 of 10.21 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 12.48 μm.

Example 5

First Aggregation and Fusion Step

To 40 parts by mass of the above-prepared dispersion liquid (1), 40 parts by mass of ion exchanged water was added and mixed. As an aggregating agent, 20 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 2.68 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 42 parts by mass of ion exchanged water was added and mixed. As an aggregating agent, 8 parts by mass of a 10% by mass aqueous sodium chloride solution was added thereto at 30° C., and the temperature of the resulting mixture was raised to 75° C. Then, the mixture was left as such for 2 hours, whereby second aggregated particles having a volume D50 of 5.79 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 5.87 μm.

Example 6

First Aggregation and Fusion Step

To 40 parts by mass of the above-prepared dispersion liquid (1), 40 parts by mass of ion exchanged water was added and mixed. As an aggregating agent, 20 parts by mass of a 10% by mass aqueous sodium chloride solution was added thereto at 30° C., and the temperature of the resulting mixture was raised to 90+ C. Then, the mixture was left as such for 2 hours, whereby first aggregated particles having a volume D50 of 3.25 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 42 parts by mass of ion exchanged water was added and mixed. As an aggregating agent, 8 parts by mass of a 10% by mass aqueous sodium chloride solution was added thereto at 30° C., and the temperature of the resulting mixture was raised to 78° C. Then, the mixture was left as such for 3 hours, whereby second aggregated particles having a volume D50 of 6.24 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 6.21 μm.

Example 7

First Aggregation and Fusion Step

To 40 parts by mass of the above-prepared dispersion liquid (1), 43 parts by mass of ion exchanged water was added and mixed. As an aggregating agent, 7 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 0.86 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 46 parts by mass of ion exchanged water was added and mixed. As an aggregating agent, 4 parts by mass of a 10% by mass aqueous sodium chloride solution was added thereto at 30° C., and the temperature of the resulting mixture was raised to 70° C. Then, the mixture was left as such for 4 hours, whereby second aggregated particles having a volume D50 of 2.85 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 2.80 μm.

Example 8

First Aggregation and Fusion Step

To 40 parts by mass of the above-prepared dispersion liquid (1), 43 parts by mass of ion exchanged water was added and mixed. As an aggregating agent, 15 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 1.34 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 46 parts by mass of ion exchanged water was added and mixed. As an aggregating agent, 4 parts by mass of a 10% by mass aqueous sodium chloride solution was added thereto at 30° C., and the temperature of the resulting mixture was raised to 75° C. Then, the mixture was left as such for 2 hours, whereby second aggregated particles having a volume D50 of 3.27 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 3.34 μm.

Example 9

First Aggregation and Fusion Step

To 20 parts by mass of the above-prepared dispersion liquid (1), 60 parts by mass of ion exchanged water was added and mixed. As an aggregating agent, 20 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 2.67 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 35 parts by mass of ion exchanged water was added and mixed. As an aggregating agent, 6 parts by mass of a 5% by mass aqueous aluminum sulfate solution was added thereto at 30° C., and the temperature of the resulting mixture was raised to 40° C. Then, the mixture was left as such for 1 hour. Thereafter, 9 parts by mass of a 10% by mass aqueous polycarboxylic acid sodium salt solution was added thereto, and the temperature of the resulting mixture was raised to 70° C. Then, the mixture was left as such for 1 hour, whereby second aggregated particles having a volume D50 of 14.24 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 14.36 μm.

Example 10

First Aggregation and Fusion Step

To 20 parts by mass of the above-prepared dispersion liquid (1), 62 parts by mass of ion exchanged water was added and mixed. As an aggregating agent, 18 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 2.49 μm were obtained.

Second Aggregation and Fusion Step

To 30 parts by mass of the dispersion liquid containing the above-prepared first aggregated particles cooled to 30° C. and 20 parts by mass of the above-prepared dispersion liquid (3), 36 parts by mass of ion exchanged water was added and mixed. As an aggregating agent, 6 parts by mass of a 5% by mass aqueous aluminum sulfate solution was added thereto at 30° C., and the temperature of the resulting mixture was raised to 40° C. Then, the mixture was left as such for 1 hour. Thereafter, 8 parts by mass of a 10% by mass aqueous polycarboxylic acid sodium salt solution was added thereto, and the temperature of the resulting mixture was raised to 70° C. Then, the mixture was left as such for 1 hour, whereby second aggregated particles having a volume D50 of 17.61 μm were obtained.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 17.52 μm.

Example 11

First Aggregation and Fusion Step

To 40 parts by mass of the above-prepared dispersion liquid (1), 45 parts by mass of ion exchanged water was added and mixed. As an aggregating agent, 15 parts by mass of a 10% by mass aqueous sodium chloride solution was added thereto at 30° C., and the temperature of the resulting mixture was raised to 80° C. Then, the mixture was left as such for 2 hours, whereby first aggregated particles having a volume D50 of 1.46 μm were obtained.

Second Aggregation and Fusion Step

To 30 parts by mass of the dispersion liquid containing the above-prepared first aggregated particles cooled to 55° C. and 20 parts by mass of the above-prepared dispersion liquid (3), 40 parts by mass of ion exchanged water was added and mixed. As an aggregating agent, 10 parts by mass of a 10% by mass aqueous sodium chloride solution was added thereto at 30° C., and the temperature of the resulting mixture was raised to 75° C. Then, the mixture was left as such for 2 hours, whereby second aggregated particles having a volume D50 of 6.16 μm were obtained. Some coarse particles were observed.

After cooling, the solid in the thus obtained dispersion liquid was washed by repeating a procedure including centrifugal separation using a centrifuge, removal of the supernatant, and washing with ion exchanged water in an amount 5 times as much as that of the solid until the electrical conductivity of the supernatant became 40 μS/cm. Then, the solid was dried using a vacuum dryer until the water content became 1.0% by mass, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 6.27 μm.

Comparative Example 1

To 15 parts by mass of the above-prepared dispersion liquid (1), 70 parts by mass of ion exchanged water was added and mixed. As an aggregating agent, 5 parts by mass of a 5% by mass aqueous aluminum sulfate solution was added thereto at 30° C. After adding the metal salt, the temperature of the resulting mixture was raised to 40° C., and the mixture was left as such for 1 hour. Thereafter, 10 parts by mass of a 10% by mass aqueous polycarboxylic acid sodium salt solution was added thereto, and the temperature of the resulting mixture was raised to 70° C. Then, the mixture was left as such for 1 hour.

After cooling, the solid in the thus obtained dispersion liquid was washed by repeating a procedure including centrifugal separation using a centrifuge, removal of the supernatant, and washing with ion exchanged water until the electrical conductivity of the supernatant became 50 μS/cm. Then, the solid was dried using a vacuum dryer until the water content became 1.0% by mass or less, whereby toner particles were obtained.

After drying, as additives, 2 parts by mass of hydrophobic silica and 0.5 parts by mass of titanium oxide were adhered to the surfaces of the toner particles, whereby a desired electrophotographic toner was obtained.

The obtained electrophotographic toner had a volume D50 of 7.61 μm.

Each of the above-prepared toners of Examples and Comparative Example was mixed with a ferrite carrier coated with a silicone resin, and a solid image was printed using a copier e-STUDIO 4520C manufactured by Toshiba Tec Corporation modified so that the temperature of the fixing device can be controlled. By using the solid images, the toners of Examples and Comparative Example were evaluated for color developing property and erasing property. Further, an image was printed using the copier e-STUDIO 4520C manufactured by Toshiba Tec Corporation, and the toners of Examples and Comparative Example were evaluated also for image quality.

The color developing property and the color erasing property were determined by measuring the image density using a reflection densitometer Macbeth Rd-19I.

The evaluation for the color developing property was performed based on the following evaluation criteria: A: density of 0.5 or more; B: density of 0.3 or more but less than 0.5; C: density of 0.2 or more but less than 0.3; and D: density of less than 0.2.

Further, the evaluation for the color erasing property was performed based on the following evaluation criteria: A: density of less than 0.1; B: density of 0.1 or more but less than 0.15; C: density of 0.15 or more but less than 0.2; and D: density of 0.2 or more.

Further, the image quality was qualitatively determined by visual observation after an image was printed. The case where the image quality was determined to be highest in comparison was evaluated as A, and the case where the image quality was determined to be lowest in comparison was evaluated as D.

As is obvious from FIG. 4, the color developing property is improved when the toner is prepared through the process of forming first aggregated particles and thereafter forming second aggregated particles using the first aggregated particles and a binder resin as Examples.

Further, the image quality is improved when the above relationship (1) is satisfied.

In addition, the image quality is further improved when the particle diameter of toner particles produced is from 3 to 15 μm.

While certain embodiments have been described, these embodiments have been presented by way of example only, and are not intended to limit the scope of invention. Indeed, the novel method described herein may be embodied in a variety of other forms; furthermore, various omissions, substitutions and changes in the form of the compound described herein may be made without departing from the spirit of the inventions. The accompanying claims and their equivalents are intended to cover such forms or modifications as would fall within the scope and spirit of the inventions.

As described in detail above, according to the technique described in this specification, a decolorable toner having an excellent color developing property can be provided.

What is claimed is:

1. A method for producing a decolorable toner comprising:

forming particles containing a color former compound, a color developing agent, and a binder resin;

forming first aggregated particles by aggregating and fusing the particles containing the color former compound, the color developing agent, and the binder resin in a dispersion medium; and forming second aggregated particles by aggregating and fusing the first aggregated particles and a binder resin in a dispersion medium.

2. The method according to claim 1, wherein the volume average particle diameter of the first aggregated particles and the volume average particle diameter of the second aggregated particles are controlled such that the following relationship (1) is satisfied:

$$m/n = 0.05 \text{ to } 0.5 \quad (1)$$

wherein m represents the volume average particle diameter of the first aggregated particles and n represents the volume average particle diameter of the second aggregated particles.

3. The method according to claim 1, wherein a dispersion liquid containing the first aggregated particles is cooled to a temperature not higher than the glass transition temperature of the binder resin aggregated and fused with the color former compound and the color developing agent plus 10° C.

4. The method according to claim 1, wherein the volume average particle diameter of the second aggregated particles is controlled such that the volume average particle diameter of toner particles falls within the range from 3 to 15 μm.

5. The method according to claim 1, further comprising encapsulating the first aggregated particles by forming an outer shell.

6. The method according to claim 1, wherein the second aggregated particles are formed by aggregating and fusing the first aggregated particles and binder resin particles in a dispersion medium, and the binder resin particles are prepared by a melt-kneading method.

7. The method according to claim 1, wherein the second aggregated particles are formed by aggregating and fusing the first aggregated particles and binder resin particles in a dispersion medium, and the binder resin particles are prepared by an emulsion polymerization method.

8. The method according to claim 1, wherein a color erasing agent is incorporated in the first aggregated particles.

* * * * *